US008033564B2

(12) United States Patent
Riepler et al.

(10) Patent No.: US 8,033,564 B2
(45) Date of Patent: Oct. 11, 2011

(54) MULTI-FUNCTIONAL GLIDING DEVICE

(75) Inventors: Bernhard Riepler, Wagrain (AT); Rupert Huber, Radstadt (AT); Helmut Holzer, Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 650 days.

(21) Appl. No.: 12/011,910

(22) Filed: Jan. 30, 2008

(65) Prior Publication Data

US 2008/0185814 A1 Aug. 7, 2008

(30) Foreign Application Priority Data

Feb. 2, 2007 (AT) ..... A 179/2007

(51) Int. Cl.
*A63C 5/02* (2006.01)

(52) U.S. Cl. ..... 280/603; 280/604

(58) Field of Classification Search ..... 280/601, 280/603, 614, 618, 624, 633, 14.22, 14.21, 280/14.26, 604, 605
See application file for complete search history.

(56) References Cited

U.S. PATENT DOCUMENTS

| | | | | |
|---|---|---|---|---|
| 4,275,904 | A * | 6/1981 | Pedersen | 280/818 |
| 5,551,728 | A * | 9/1996 | Barthel et al. | 280/818 |
| 5,649,722 | A | 7/1997 | Champlin | |
| 5,816,590 | A | 10/1998 | Fey et al. | |
| 5,984,324 | A | 11/1999 | Wariakois | |
| 6,000,711 | A | 12/1999 | Fey et al. | |
| 6,523,851 | B1 | 2/2003 | Maravetz | |
| 2002/0185828 | A1 * | 12/2002 | Melcher | 280/14.26 |

FOREIGN PATENT DOCUMENTS

| | | |
|---|---|---|
| CH | 681 509 | 4/1993 |
| CH | 684 825 | 1/1995 |
| DE | 38 06 061 | 9/1988 |
| DE | 89 03 154 | 8/1989 |
| DE | 91 02 236 | 5/1991 |
| DE | 296 18 514 | 2/1997 |
| DE | 197 03 773 | 8/1998 |
| EP | 0 362 782 | 4/1990 |
| FR | 2 611 345 | 9/1988 |

OTHER PUBLICATIONS

European Search Report dated Jul. 3, 2008 with an English translation of the relevant parts.

* cited by examiner

*Primary Examiner* — Frank Vanaman
(74) *Attorney, Agent, or Firm* — Collard & Roe, P.C.

(57) ABSTRACT

A multi-functional board-type gliding device, which has two end portions spaced at a distance apart from another in the direction of a longitudinal axis and is designed to be split in its longitudinal extension to form gliding part-devices . Several first and second coupling mechanisms are disposed in the direction of longitudinal extension in order to provide a mutual connection between the two gliding part-devices. The two mutually coupled gliding part-devices constitute a first operating mode and in the position separated from one another constitute a second operating mode. In the first operating mode in the coupled position, the two gliding part-devices form a first end portion which defines a first direction of use. In the second operating mode in the position separated from one another, the or the other end portions define a second direction of use opposite the first direction of use.

19 Claims, 8 Drawing Sheets

MULTI-FUNCTIONAL GLIDING DEVICE

Applicants claim priority under 35 U.S.C. §119 of AUSTRIAN Patent Application No. A 179/2007 filed on Feb. 2, 2007.

BACKGROUND OF THE INVENTION

1. Field of the invention

The invention relates to a multi-functional board-type gliding device, which has end portions spaced at a distance apart from one another in the direction of a longitudinal axis and is designed so that it can be split into gliding part-devices in its longitudinal extension, with several first and second coupling mechanisms disposed in the direction of the longitudinal extension for mutually connecting the two gliding part-devices, and the two mutually coupled gliding part-devices represent a first operating mode whereas they represent a second operating mode when in a position separated from one another, and having binding mechanisms.

2. Prior art

Patent specification CH 681 509 A5 discloses a separable snowboard which can be split longitudinally to form a pair of skis and is provided with means for releasably connecting the two snowboard parts. Provided on the snowboard as part of these connecting means are detachably mountable binding plates with a high bending strength disposed across and beyond its separating gap substantially transversely to its longitudinal extension and essentially on the external face of the snowboard parts. In addition, a respective releasable connection is provided between the binding plates and the two snowboard parts in the vicinity of the separating gap. There is a standard direction of usage for the two different usage modes.

Another snowboard which can be separated in the direction of its longitudinal extension is disclosed in patent specification EP 0 362 782 B2. The snowboard essentially comprises releasable parts disposed parallel and adjacent to one another in the longitudinal direction, which are provided with shoe retaining mechanisms enabling a person using the snowboard to be retained on it. The shoe retaining mechanism can be positioned in at least two positions on the snowboard. One position is essentially oriented in the longitudinal direction with respect to the snowboard and another position is oriented extending essentially transversely thereto. The purpose of the two shoe retaining mechanisms is to hold the two parts of the snowboard together.

Another snowboard designed to be split along its longitudinal axis is disclosed in patent specification DE 197 03 773 A1. The left-hand and right-hand halves of the snowboard are of a symmetrical design and the two halves can be connected and secured relative to one another to form the rigid snowboard by means of transverse locking systems in the front, middle and rear regions. In order to adapt to different snow conditions, an extension element in the form of a middle piece can be inserted between the two halves and fills the gap across the entire length. The two halves and the extension element can be rigidly connected to one another by the same transverse locking systems used to join the two halves only in order to obtain the normal width. Similar interconnecting parts are known from DE 89 03 154 U1 and DE 296 18514 U1.

Other snowboards which can be split are disclosed in patent specifications U.S. Pat. Nos. 5,649,722 A, 5,816,590 A, 5,984,324 A and 6,523,851 B1. In these instances, different coupling mechanisms are used to connect the two halves when separated from one another to form a unit again. All of these separable snowboards operate on the basis of a single direction during use.

SUMMARY OF THE INVENTION

The underlying objective of this invention is to improve the overall functionality and use of the gliding device and the individual gliding part-device.

This objective is achieved due to the fact that, in the first operating mode based on the coupled position, the two gliding part-devices form a first end portion which defines a first direction of use, and in the second operating mode in the position separated from one another, the or the other end portions define a second direction of use opposite the first direction of use.

The surprising advantage gained by the features according to the invention resides in the fact that a separate direction of use is provided for each of the different operating modes. This being the case, the terminal design of the end portions spaced apart from one another in the longitudinal direction can be optimally adapted to the respective intended purpose. In the first operating mode, a closed shovel design can be obtained for the purpose of downhill travel—what might be referred to as a "nose". For climbing or downhill travel in the second operating mode, on the other hand, the other end portion may be specially adapted to this purpose as an alternative. Due to the possibility of being able to split the gliding device, allowance can be made for each application individually and a specially designed shovel end can be obtained for every direction of movement.

Also of advantage is another embodiment that has the first end portion in the first operating mode bounded by a first curve continuously curving in the same direction and extending between the outwardly lying longitudinal edges. This embodiment enables an intrinsically curved shaped to be obtained in the first end portion for the first operating mode, representing a standard terminal design of a snowboard in the intended direction of movement. It is therefore also possible to make special allowance for downhill behavior and the associated lift.

An embodiment that in the second direction of use, has each of the two other end portions of the gliding part-devices bounded by an arcuate, convex second curve is also of advantage because as an alternative to the first direction of use or movement, a specially provided shovel design can be obtained in the other end portion. Due to the preferably symmetrical design of the second curved shape, a uniform and symmetrical force can be transmitted from the tip or shovel for climbing and also for downhill travel when the gliding part-devices are separated from one another. Furthermore, it is also possible to opt for a direction of use opposite the normal direction of use in the first operating mode and this will result in only a slight restriction due to the wedge between the gliding part-devices.

As a result of the embodiment that in the first operating mode has mutually facing longitudinal edges of the two gliding part-devices extending in a straight line as viewed in their longitudinal extension, it is possible to produce a virtually closed running surface in the region or the running surface or gliding surface of the gliding device in the first operating mode. This results in good gliding properties in spite of the ad-vantage gained by being able to obtain separate gliding part-devices for climbing.

As a result of another embodiment that in the first operating mode has the longitudinal edges extending on the outside of the gliding part-devices respectively to form an arcuately curved contour on the gliding part-device, the gliding device is able to turn irrespective of the contour for the first operating mode.

Also of advantage is another embodiment with longitudinal edges extending on the outside in the first operating mode respectively to form the mutually facing inner edges of the gliding part-devices in the second operating mode, because the user is able to improve travel behavior, even during downhill travel, by deliberately switching the arcuately curved contour in the region of the longitudinal edges to a position in the region of inner edges. Due to the contoured design of the inner edges, therefore, it is possible to shift the load to the outer ski when turning, thereby enabling the arcuately curved longitudinal edges to be used which significantly improves the travel behavior and hence control for the user.

Another embodiment has first coupling mechanisms disposed in the two end portions disposed at a distance apart from another in the longitudinal direction which have respective first and second coupling means, and in the first operating mode, has the first coupling means retained respectively on the two gliding part-devices disposed directly adjacent to one another, has the first coupling means co-operating with the second coupling means in order to couple the two gliding part-devices, and in the second operating mode, has the second coupling means each forming a climbing aid for the binding mechanism. The advantage of this embodiment is that, due to the multi-functional way in which the second coupling means can be used, there is no need to provide additional aids for the first coupling mechanism, thereby reducing the risk of their being lost or forgotten on the one hand and enabling the second coupling means to be used as a climbing aid for climbing. It can also be used as a coupling means for the gliding part-devices during downhill travel. This saves on weight and extra equipment for the use.

As a result of another embodiment with the multi-functional way for using the second coupling means described above and further with the first coupling means being of a block-shaped design and having respective orifices disposed in alignment with one another in the vertical direction by reference to the longitudinal edges extending in a straight line between the two gliding part-devices, a flat orientation of the two gliding part-devices with respect to one another can be produced in the region of the running surface in combination with the second coupling means.

Due to the embodiment with the multi-functional way for using the second coupling means described above and further with the second coupling means also comprising a U-shaped base body with a first base part and first leg parts, and also further with a connecting element being retainded on the first base part and the connecting element and first leg parts pointing more or less the same direction of extension, the first leg parts may be used as tensioning elements for the coupling operation in co-operation with the bracket part and the mutually flat orientation of the gliding part-devices can also be produced by means of the connecting element.

Also of advantage is an embodiment with the multi-functional way for using the second coupling means described above, and further with the first leg parts being used as tensioning elements as described above, in which the second coupling means has a U-shaped bracket part comprising a second base part and second leg parts and the second leg parts are pivotably connected to the first leg parts of the base body. This embodiment is advantageous because not only can a mutual clamping of the base bodies of the first coupling means be obtained, their height can also be varied for use as a climbing aid.

In one embodiment with the multi-functional way for using the second coupling means described above, the first and second coupling means are in the coupled position, the connecting element of the second coupling means is inserted in the aligned orifices of the first coupling means and the U-shaped base body extends round certain parts of the first coupling means, and the first base part is supported on one of the first coupling means and the second base part of the U-shaped bracket part extends over another of the first coupling means and pushes the two first coupling means against one another in the vertical direction by reference to the longitudinal edges disposed between the two gliding part-devices. In this manner, the two gliding part-devices can be perfectly coupled in the portion of the mutually facing longitudinal edges, thereby resulting in a good mutual stabilization of the two gliding part-devices with respect to one another.

In this respect, a design uses the multi-functional way for using the second coupling means described above, and further has the second coupling means having at least one coupling part inserted in a coupling recess in the binding mechanism, which serves as a climbing aid in the second operating mode. This has proved to be of advantage because the second coupling means used as a climbing aid can be attached to the binding mechanism without the need for additional aids or connecting means.

As a result of another advantageous embodiment with the multi-functional way for using the second coupling means described above, and further with the second coupling means having at least one coupling part which is inserted in a coupling recess in the binding mechanism for serving as a climbing aid in the second operating mode as described above, and further with the first leg parts defining a first height and the second base part of the U-shaped bracket part forming a bigger second height in co-operation with the first leg parts, different angles of inclination between the top face of the gliding part-devices and the horizontal can be compensated during climbing, thereby permitting an individual adjustment to the steepness of the uphill slope. In conjunction with the gliding part-devices, this significantly facilitates or makes easier for a user the upward movement and also means that not quite so much force has to be applied.

Also of advantage is an embodiment with the multi-functional way for using the second coupling means described above, with the second coupling means also comprising a U-shaped base body with a first base part and first leg parts, a connecting element being retained on the first base part, and the connecting element and first leg parts pointing more or less the same direction of extension as described above, and further with at least one stop element being provided on at least one of the first leg parts of the U-shaped base body, which co-operates with the U-shaped bracket part serving as a climbing aid in the second operating mode and fixes it in its position relative to the U-shaped base body. This embodiment is advantageous because the two elements are additionally blocked relative to one another, which means that higher forces can also be transmitted, for example when the binding region is pressed or dug into the snow.

With an embodiment in which in the first operating position, the binding mechanism forms a first coupling element of the second coupling mechanisms and co-operates with several second coupling elements respectively disposed on the two gliding part-devices in the portion of the longitudinal edges extending in a straight line, the binding mechanism can be used as a coupling element for the second coupling mechanism without the need for additional aids. This obviates the need for additional connecting means and reduces the volume which a user has to carry.

As a result of the embodiment in which in the first operating position, the binding mechanism forms a first coupling element of the second coupling mechanisms and co-operates with several second coupling elements respectively disposed on the two gliding part-devices in the portion of the longitudinal edges extending in a straight line, as is described above, and further wherein the first coupling element of the embodiment comprises at least one coupling orifice and a lock element and the second coupling element comprises at least one coupling pin with a recess such as an undercut disposed in it, and a support element such as a collar, and the lock element is designed so that it can be moved relative to the coupling orifice from a release position into a locking position and the lock element extends under the support element and thus locates in-the recess in the locked position, even though there is no relative shifting of the binding mechanism with respect to the gliding device during the coupling operation, a reliable mutual coupling and locking action can nevertheless be obtained for this operating mode.

Another option is an embodiment in which in the first operating position, the binding mechanism forms a first coupling element of the second coupling mechanisms and co-operates with several second coupling elements respectively disposed on the two gliding part-devices in the portion of the longitudinal edges extending in a straight line as is described above and wherein the first and second coupling elements are disposed on a common pitch circle with a center, whereby the relative displacement of the locking element can be achieved by a simple rotating movement, thereby enabling a coupling to be established with several coupling pins simultaneously.

An embodiment has in the first operating position, the binding mechanism forming a first coupling element of the second coupling mechanisms and co-operating with several second coupling elements respectively disposed on the two gliding part-devices in the portion of the longitudinal edges extending in a straight line, as is described above, and further has the first coupling element comprising at least one coupling orifice and a lock element and the second coupling element comprising at least one coupling pin with a recess such as an undercut disposed in it, and a support element such as a collar, and the lock element designed so that it can be moved relative to the coupling orifice from a release position into a locking position and the lock element extending under the support element and thus locating in the recess in the locked position, and further has the lock element disposed on a disc-shaped component and able to be pivoted or rotated about the center of the common pitch circle of the coupling elements. This embodiment saves on other additional parts and thus significantly facilitates use because the second coupling mechanism can be locked and a simple retaining or locking means for the climbing aid or crampon can be obtained on a single disc-shaped component.

An embodiment has in the first operating position, the binding mechanism forming a first coupling element of the second coupling mechanisms and co-operating with several second coupling elements respectively disposed on the two gliding part-devices in the portion of the longitudinal edges extending in a straight line, as is described above, and further has the first coupling element comprising at least one coupling orifice and a lock element and the second coupling element comprising at least one coupling pin with a recess such as an undercut disposed in it, and a support element such as a collar, and has the lock element designed so that it can be moved relative to the coupling orifice from a release position into a locking position and has the lock element extending under the support element and thus locating in the recess in the locked position, and has another locking element, in particular of a resilient design, co-operating with the lock element, which lies against the support element in the locked position. The advantage of this embodiment is that any inadvertent releasing of the second coupling mechanisms is prevented. This results in higher safety for the user, even in the event of impacts or flexing during use.

Finally, another embodiment has in the first operating position, the binding mechanism forming a first coupling element of the second coupling mechanisms and co-operating with several second coupling elements respectively disposed on the two gliding part-devices in the portion of the longitudinal edges extending in a straight line, as is described above, and further has the first coupling element comprising at least one coupling orifice and a lock element and the second coupling element comprising at least one coupling pin with a recess such as an undercut disposed in it, and a support element such as a collar, and the lock element designed so that it can be moved relative to the coupling orifice from a release position into a locking position and the lock element extending under the support element and thus locating in the recess in the locked position, and has the disc-shaped component, which incorporates the lock elements, having at least one other blocking element which extends into a coupling path between the coupling part and the coupling recess when the gliding part-devices are in the second operating mode and has the coupling part of the second coupling means inserted in the coupling recess of the binding mechanism. As a result of using the universal disc-shaped component, not only is a coupling established between the coupling elements of the second coupling mechanism, other components such as the climbing aid or crampon, can also be securely attached to the binding mechanism.

BRIEF DESCRIPTION OF THE DRAWINGS

The invention will be described in more detail below with reference to examples of embodiments illustrated in the appended drawings.

Of these.

DETAILED DESCRIPTION OF PREFERRED EMBODIMENTS

Figure 1:
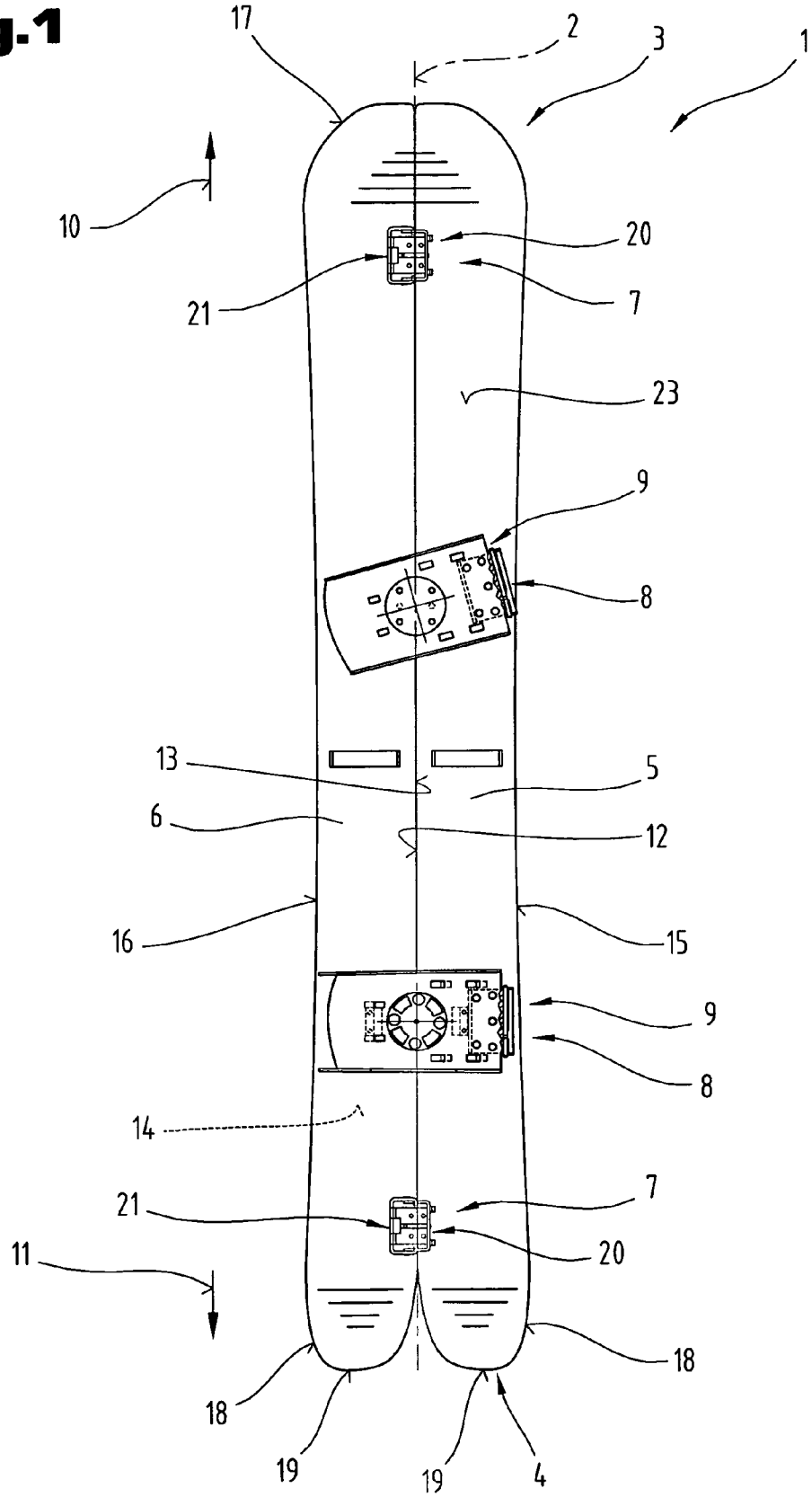
FIG. 1 is a simplified, schematic diagram showing a plan view of a gliding device proposed by the invention, designed to be split apart in a first operating mode.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
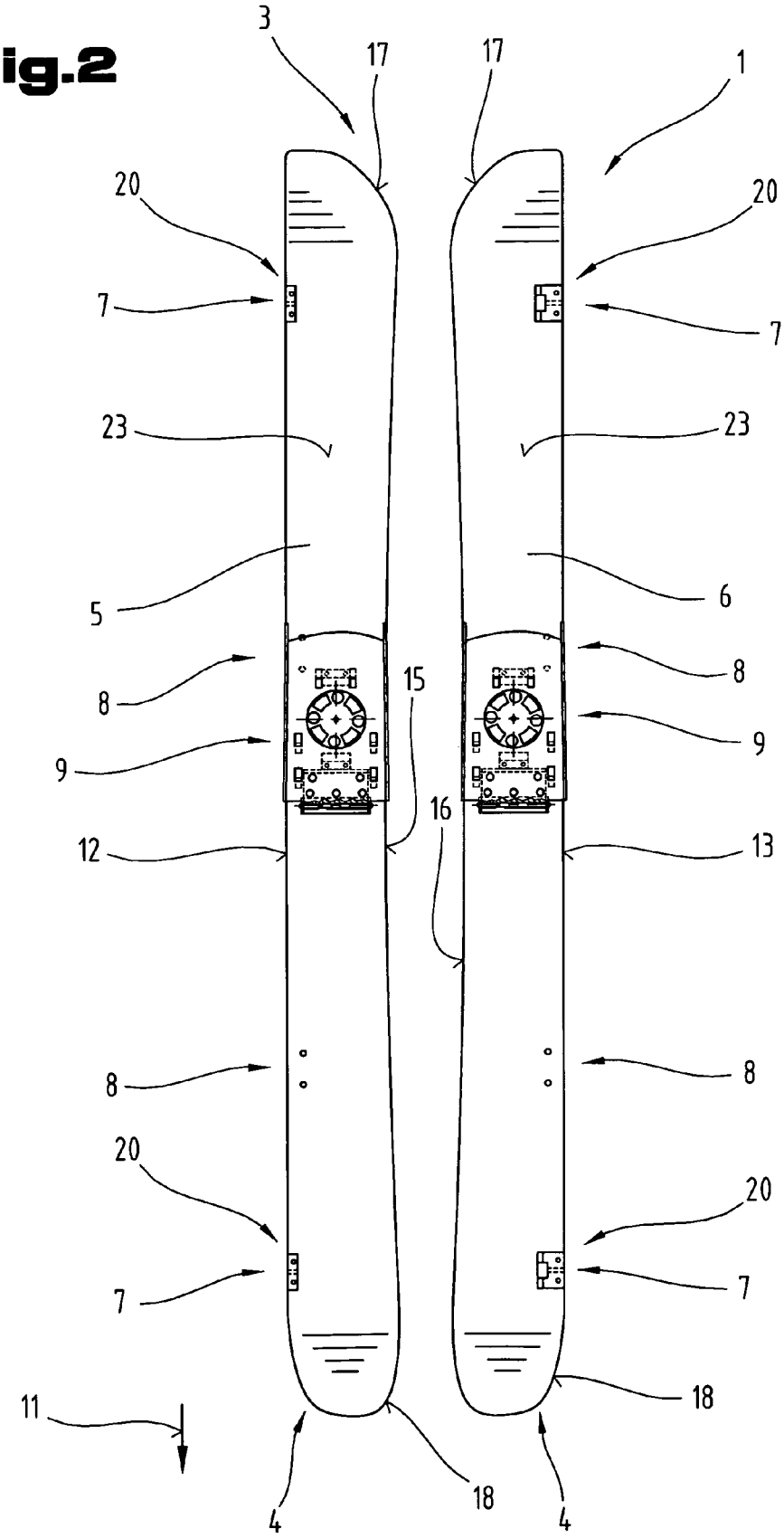
FIG. 2 is a simplified, schematic diagram showing the gliding device illustrated in FIG. 1 in its second operating mode with the gliding part-devices in a position separated from one another.

FIGS. 1 and 2 illustrate a multi-functional, board-type gliding device 1 in different usage or operating modes, with end portions 3, 4 spaced apart from one another in the direction of a longitudinal axis 2. In the direction of its longitudinal extension, the board-type gliding device 1 is designed so that it can be split into gliding part-devices 5, 6. To establish a mutual connection between the two gliding part-devices 5, 6 and thus form the board-type gliding device 1, several first and second coupling mechanisms 7, 8 are provided in the direction of the longitudinal extension.

As may best be seen from FIG. 1, the two first coupling mechanisms 7 are disposed in the region of and adjacent to the first end portion 3 and second end portion 4 and are used to form a unit, namely the gliding device 1 as a whole, when the gliding part-devices 5, 6 are in their position coupled or connected to one another. A more detailed description of the first coupling mechanisms 7 will be given with reference to the subsequent drawings. The second coupling mechanisms 8 are in the portion where binding mechanisms 9 are provided and are partially formed by them. A more detailed description of these will also be given with reference to the subsequent drawings.

FIG. 1 illustrates the gliding device 1 in a so-called first operating mode when the gliding part-devices 5, 6 are coupled. In FIG. 2, on the other hand, the two gliding part-devices 5, 6 are illustrated in a position separated from one another and thus constitute a so-called second operating mode. The gliding device 1 may therefore also be termed or called a separable snowboard, and the two gliding part-devices 5, 6 may be used in the second operating mode as skis for example, in particular as touring skis, for climbing uphill and, if necessary, for downhill travel.

As may best be seen from a comparison of FIGS. 1 and 2, the two gliding part-devices 5, 6 form the first end portion 3 in the first operating mode in the coupled position, which therefore defines a first direction of use 10—indicated by the arrow. In the second operating mode when the gliding part-devices 5, 6 are in the position separated from one another, on the other hand, the other end portions 4 define a second direction of use 11 opposite the first direction of use 10—see arrow. As a result, it is possible to provide the two end portions 3, 4 with a separate termination or a separate curved or shovel shape for each of the usages or operating modes.

The two gliding part-devices 5,6 disposed directly next to or adjacent to one another in the first operating mode each have mutually facing longitudinal edges 12, 13, which in the embodiment illustrated as an example here extend in a straight line in the longitudinal direction thereof. This results in an intrinsically closed gliding surface 14 for the gliding device 1, thus forming a unit in the first operating mode. The two gliding part-devices 5, 6 can be connected to form the unit comprising the gliding device 1 without any intermediate components.

The longitudinal edges 15, 16 of the gliding part-devices 5, 6 extending at the outer side in the first operating mode illustrated in FIG. 1 respectively form an arcuately curved contour on the gliding device 1 when looking down onto it. This is dependent on the intended purpose and may extend over only a part-region between the first and the second end portions 3, 4 or alternatively across the entire longitudinal extension of the gliding part-devices 5, 6. In the first operating mode of the gliding device 1, therefore, a conventional snowboard is formed, with the longitudinal edges 15, 16 disposed on the outside in this instance, which permits the use of a contoured edge in a manner known from the prior art.

As may best be seen from FIG. 1, the first end portion 3 is bounded by a first curve 17 extending approximately between the outwardly lying longitudinal edges 15, 16 and curving continuously in the same direction in the first operating mode. Consequently, when the gliding part-devices 5, 6 are in the separated position, an asymmetrical shovel design is obtained in the first end portion 3 but this forms the convexly curved first curve 17 in the first operating mode, in other words when the gliding part-devices 5, 6 are coupled.

In the second direction of use 11, on the other hand, each of the two end portions 4 of the two gliding part-devices 5, 6 has an arcuate convexly curving second curve 18. This convexly curved second curve 18 may correspond to a standard design of the shovel shape of skis, in particular touring skis. In the assembled state, in other words the first operating mode, a wedge-shaped gap is formed in the second end portion 4, starting from the mutually facing longitudinal edges 12, 13 extending in the direction of a tip 19.

In the second operating mode and using the gliding part-devices 5, 6 in their second direction of use 11, the user is free to use longitudinal edges 12 respectively 13 and 15 respectively 16 with a different longitudinal contour as so-called inner edges or alternatively also as outer edges. As illustrated in FIG. 2, what in the first operating mode were longitudinal edges 15, 16 extending on the outer side respectively form mutually facing inner edges of the gliding part-devices 5, 6 in the second operating mode. This means that a user of the gliding part-devices 5, 6 can use the contoured longitudinal edges 15, 16, not only when climbing but also during downhill travel to improve steering and turning as inner edges on the respective outer ski by applying the appropriate load. During turning, the load usually tends to prevail primarily on the outer ski, which means that in this instance, the inwardly lying contoured longitudinal edges 15, 16 can be used alternately. This makes it easier to turn, which is much more difficult if using straight longitudinal edges 12, 13 as inner edges. For the downhill position, an appropriate additional lock or block is provided for the binding mechanism 9, although this is not illustrated in detail. In the second operating mode, therefore, it is now possible both to climb and travel downhill with skins fitted on the running surface.

FIGS. 3 to 10 illustrate the first coupling mechanism 7 and the components from which it is made up in more detail. These embodiments of the first coupling mechanism 7 may be construed as independent solutions proposed by the invention in their own right, and in order to avoid unnecessary repetition, reference may be made to the descriptions given in connection with FIGS. 1 and 2 above.

Figure 3:
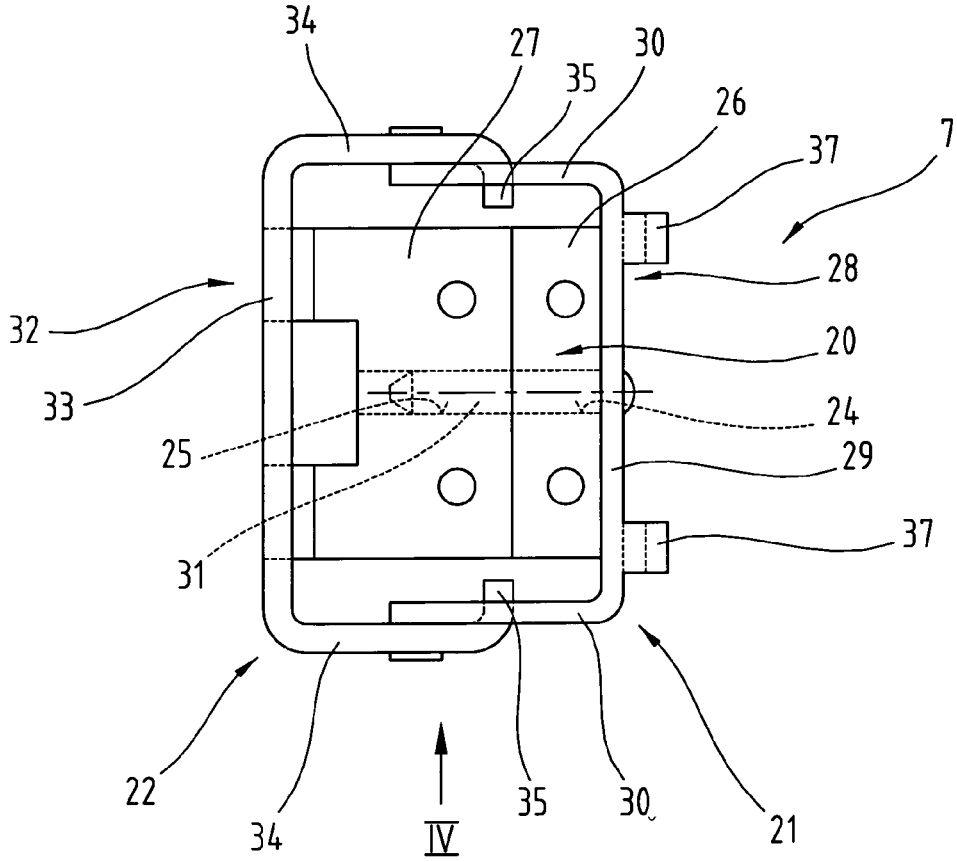
FIG. 3 is a simplified, schematic diagram showing a plan view of a first coupling mechanism with first and second coupling means for mutually coupling the gliding part-devices.
Figure 4:
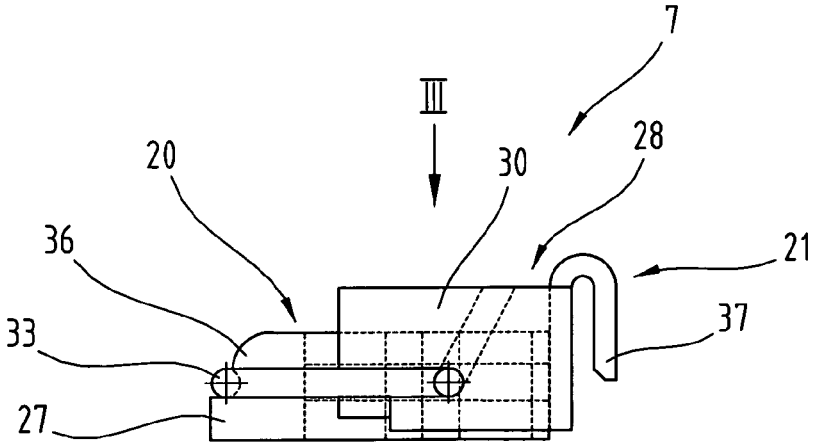
FIG. 4 is a view of the first coupling mechanism illustrated in FIG. 3, viewed in the direction of arrow IV indicated in FIG. 3.
Figure 5:
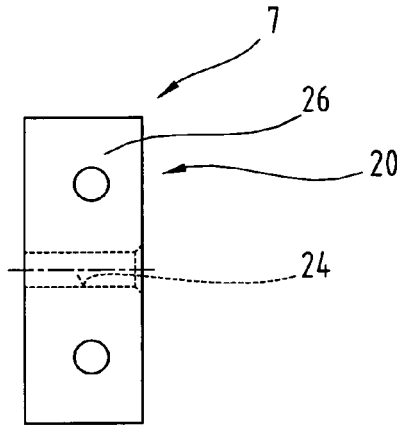
FIG. 5 is a simplified, schematic diagram showing a plan view of a first base body of the first coupling means.
Figure 6:
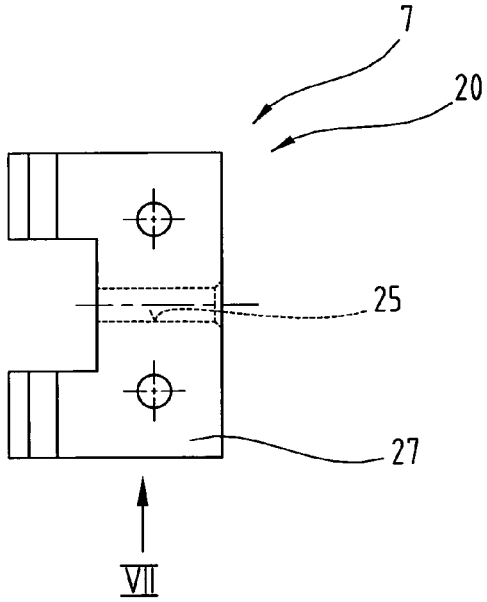
FIG. 6 is a simplified, schematic diagram showing a plan view of another base body of the first coupling means.
Figure 7:
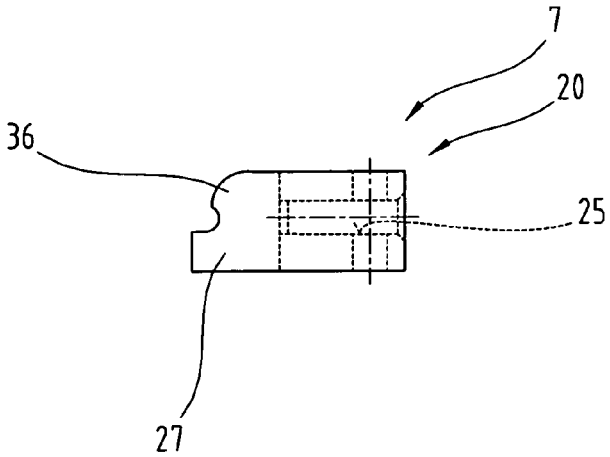
FIG. 7 shows the other base body illustrated in FIG. 6, viewed in the direction of arrow VII indicated in FIG. 6.

As may be seen from a comparison of FIGS. 3 and 4, the first coupling mechanism 7 is illustrated in the coupled state but without gliding part-devices 5, 6. The first coupling mechanism 7 comprises respective first and second coupling means 20, 21, and in the first operating mode, the first coupling means 20 is respectively retained on the two immediately adjacent gliding part-devices 5, 6 and coupled with the two gliding part-devices 5, 6 in co-operation with the or more than one second coupling means 21. In the second operating mode, the second coupling means 21 respectively serves as a climbing aid for the binding mechanism 9, which will be described in more detail below. The purpose of the climbing aid 22 is to restrict the binding mechanisms 9, mounted so as to pivot relative to the gliding part-devices 5, 6, in their pivoting movement with respect to the gliding part-devices. To this end, the climbing aid 22 is mounted on the bottom face of the binding mechanism 9 and projects in the direction towards a top face 23 of the gliding part-devices 5, 6 or the gliding device 1. The purpose of the pivotably mounted binding mechanism 9 is to make walking movements with the gliding part-devices 5, 6 easier for a user, in a manner long familiar to touring skiers who own their own touring bindings. As the uphill terrain becomes steeper, i.e. the angle between a horizontal and the gliding part-devices 5, 6 becomes bigger, the user would pivot backwards with the binding mechanism 9 onto the top face 23 of the gliding part-devices 5, 6 when supported on the gliding part-devices 5, 6 without the use of the climbing aid 22. This means that in an approximately upright or vertical walking position, it is necessary to lean forwards to a large extent by reference to the gliding part-devices 5, 6, thereby tensing the leg muscles and Achilles tendon. If, on the other hand, the climbing aid 22 is used, the angle between the gliding part-devices 5 respectively 6 and the binding mechanisms 9 is limited when supported and thus made bigger because a full backward pivoting movement as far as the top face 23 is prevented. As a result, the plane of the binding mechanism 9 whilst being supported is shifted back closer to the horizontal, making the climbing movement more natural and to a certain extent also requiring less force.

As may be seen more clearly from a comparison of FIGS. 3 to 7, the first coupling means 20 is respectively block-shaped and is disposed in the vertical direction by reference to the longitudinal edges 12, 13 extending in a straight line between the two gliding part-devices 5, 6, each being provided with orifices 24, 25 disposed in alignment with one another. In the embodiment illustrated as an example here, the first coupling means 20 each comprise a base body 26, 27. Each of the respective base bodies 26, 27 co-operates respectively with one of the gliding part-devices 5, 6 and is retained on it in a stationary arrangement in each of the operating modes.

Figure 8:
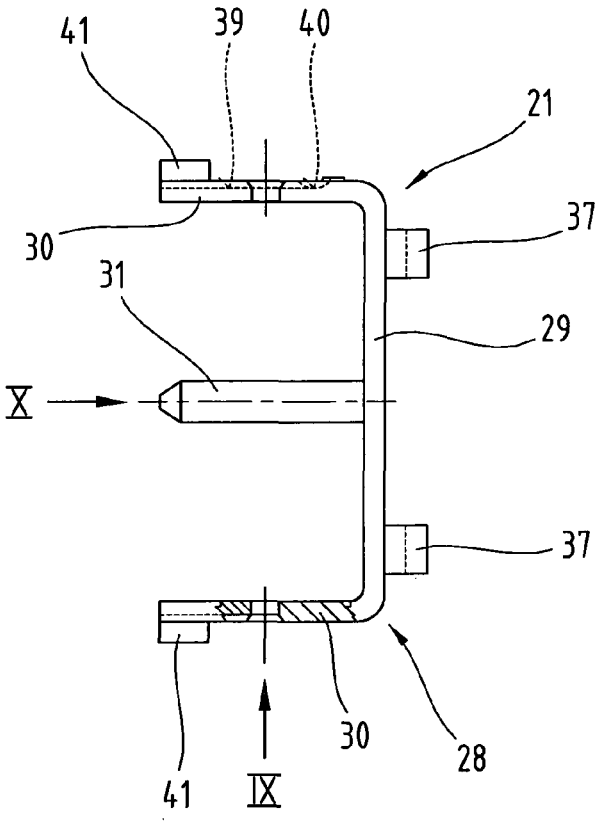
FIG. 8 is a simplified, schematic diagram showing a plan view in partial section of the second coupling means of the first coupling mechanism.
Figure 10:
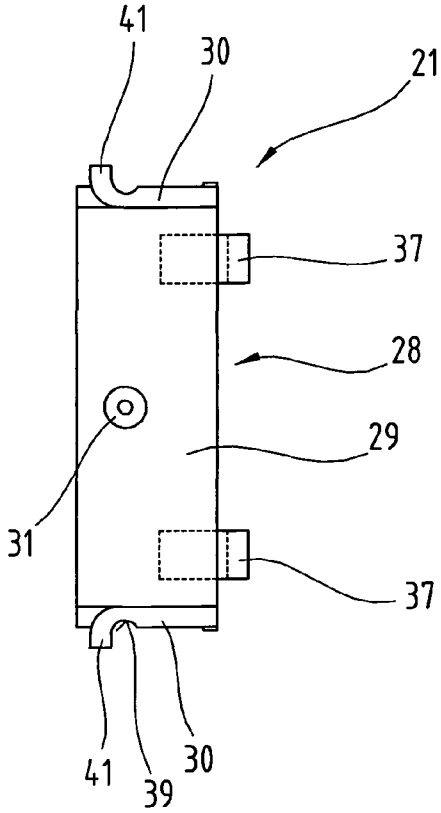
FIG. 10 shows the second coupling means illustrated in FIGS. 8 and 9, in a side view in the direction of arrow X indicated in FIG. 8.
Figure 9:
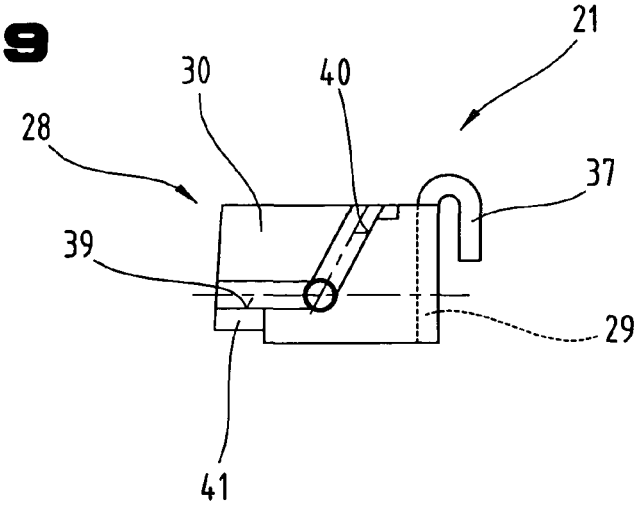
FIG. 9 shows the second coupling means illustrated in FIG. 8, in the direction of arrow IX indicated in FIG. 8.

FIGS. 8 to 10 illustrate the other coupling means 21, which co-operates with the coupling means 20 described above, in particular its base body 26, 27, and is used to couple the two gliding part-devices 5, 6. In the embodiment illustrated as an example here, the second coupling means 21 comprises a U-shaped base body 28 with a first base part 29 and first leg parts 30. The base body 28 may be a flat material made from a range of different substances. The second coupling means 21 also has what in this instance is a bolt-shaped connecting element 31, which is retained on the first base part 29. The connecting element 31 and the two first leg parts 30 point more or less in the same direction of extension. The connecting element 31 is preferably centrally disposed between the two first leg parts 30 and in the first operating mode, in other words when the gliding part-devices 5, 6 are coupled with one another, is inserted in the orifices 24, 25 of the first coupling means 20. Accordingly, the connecting element 31 extends through the two base bodies 26, 27 at least in the region of mutually facing sides, thereby resulting in a mutual orientation and fixing in the direction perpendicular to the top face 23 based on an appropriate choice of fit.

As may be seen more clearly from FIGS. 3 and 4, the second coupling means 21 also comprises another more or less U-shaped bracket part 32. This bracket part 32 in turn comprises a second base part 33 and second leg parts 34, which are each pivotably connected to the first leg parts 30 of the base body 28. The bracket part 32 may be made from a bent round material, which has an inwardly bent pivot pin 35 respectively on the ends of the second leg parts 34 remote from the second base part 33. This pivot pin 35 locates in an orifice in the first leg parts 30 of the base body 28 and can be pivoted in terms of its position relative to the base body 28.

In the coupled position illustrated in FIGS. 3 and 4, the connecting element 31 is inserted in the two orifices 24, 25 of the first coupling means 20, as described above. Accordingly, the U-shaped base body 28 extends around at least certain regions of the first coupling means 20, and the first base part 29 is supported on what is here the first coupling means 20, for example the base body 26, optionally with a spacer element connected in between. The second base part 27 of the first coupling means 20 is therefore surrounded by the U-shaped bracket part 32 on the side remote from the first base part 29, as may best be seen from FIG. 4. In order to produce a reliable hold when the bracket part 32 is in the locked position on the base body 27, it preferably has a catch lug 36 running through at least certain regions but preferably across the longitudinal extension of the base parts 33. In addition to mutually orienting the two base bodies 26, 27 in co-operation with the connecting element 31, this also results in a mutual clamping of the two gliding part-devices 4, 5 in the vertical direction by reference to the longitudinal edges 12, 13 extending between them. By disposing the first coupling mechanisms 7 in the immediate vicinity of the two end portions 3, 4, the two gliding part-devices 5, 6 are blocked and fixed with respect to one another in this portion in the first operating position.

Figure 11:
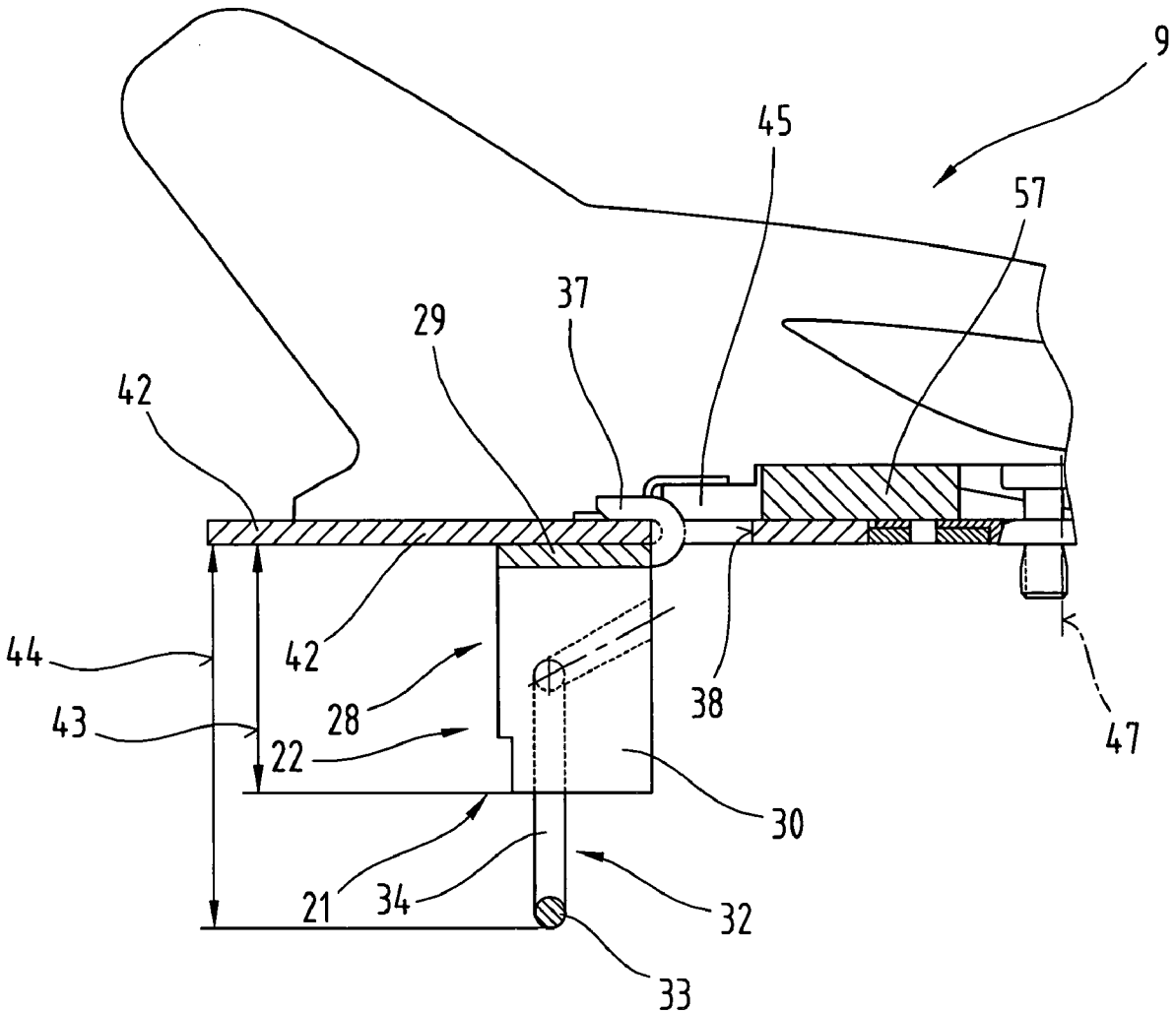
FIG. 11 is a view in section showing the second coupling means of the first coupling mechanism used as a climbing aid for the binding mechanism.

The other coupling means 21, namely the base body 28, also has at least one coupling part 37, which is inserted in a coupling recess 38—see FIG. 11—in the binding mechanism 9 in the second operating mode and used as a climbing aid 22. In the embodiment illustrated as an example here, the coupling part or parts 37 are disposed on the base part 29 and are bow-shaped or U-shaped.

As also illustrated in FIG. 9, catch orifices 39, 40 are provided, bored into the first leg parts 30, extending from the orifice for accommodating the pivot pin 35 of the bracket part 32. When the bracket part 32 is pivoted accordingly as well as biased and co-operating with the catch orifices 39, 40, the bracket part 32 can be oriented and its position fixed relative to the base body 28 of the second coupling means 21.

In order to provide correct positioning and additional fixing when the first and second leg parts 30, 34 are oriented more or less parallel with one another, at least one stop element 41 may be provided on the first leg part 30 of the base body 28, which co-operates with the U-shaped bracket part 32 in the first operating mode and optionally also in the second operating mode acting as a climbing aid 22 and secures it in its position relative to the U-shaped base body 28.

FIG. 11 illustrates the climbing aid 22 on the binding mechanism 9 in the second operating mode, providing a simplified, schematic diagram of the coupled position between the coupling part 37 and the coupling recess 38 in a base plate 42. The first leg parts 30 of the base body 28 define a first height 43. When the two leg parts 30, 34 are oriented parallel with one another, the second base part 33 co-operating with the base body 28, in particular its first leg parts 30, defines a bigger second height 44. As explained above in connection with how the climbing aid 22 is used, different angles of inclination between the top face 23 of the gliding part-devices 5, 6 and the binding mechanism 9 can be compensated as it its supported and during the pivoting movement.

Also illustrated on a simplified basis is the fact that a blocking element 45 may be provided for the coupling part 37 inserted in the coupling recess 38, which can be transferred from a release position into a blocking position. The purpose of the release position is to enable the coupling part 37 to be inserted in the coupling recess 38 and once the blocking element 45 has been transferred or pivoted into the blocking position, the climbing aid 22 is reliably prevented from working inadvertently loose from the binding mechanism 9. This blocking element 45 may be part of a disc-shaped component 57 for example—see also FIGS. 12 and 13—which is able to pivot or rotate about a rotation axis 47, as will be explained in more detail below in connection with the binding mechanism 9.

Figure 12:
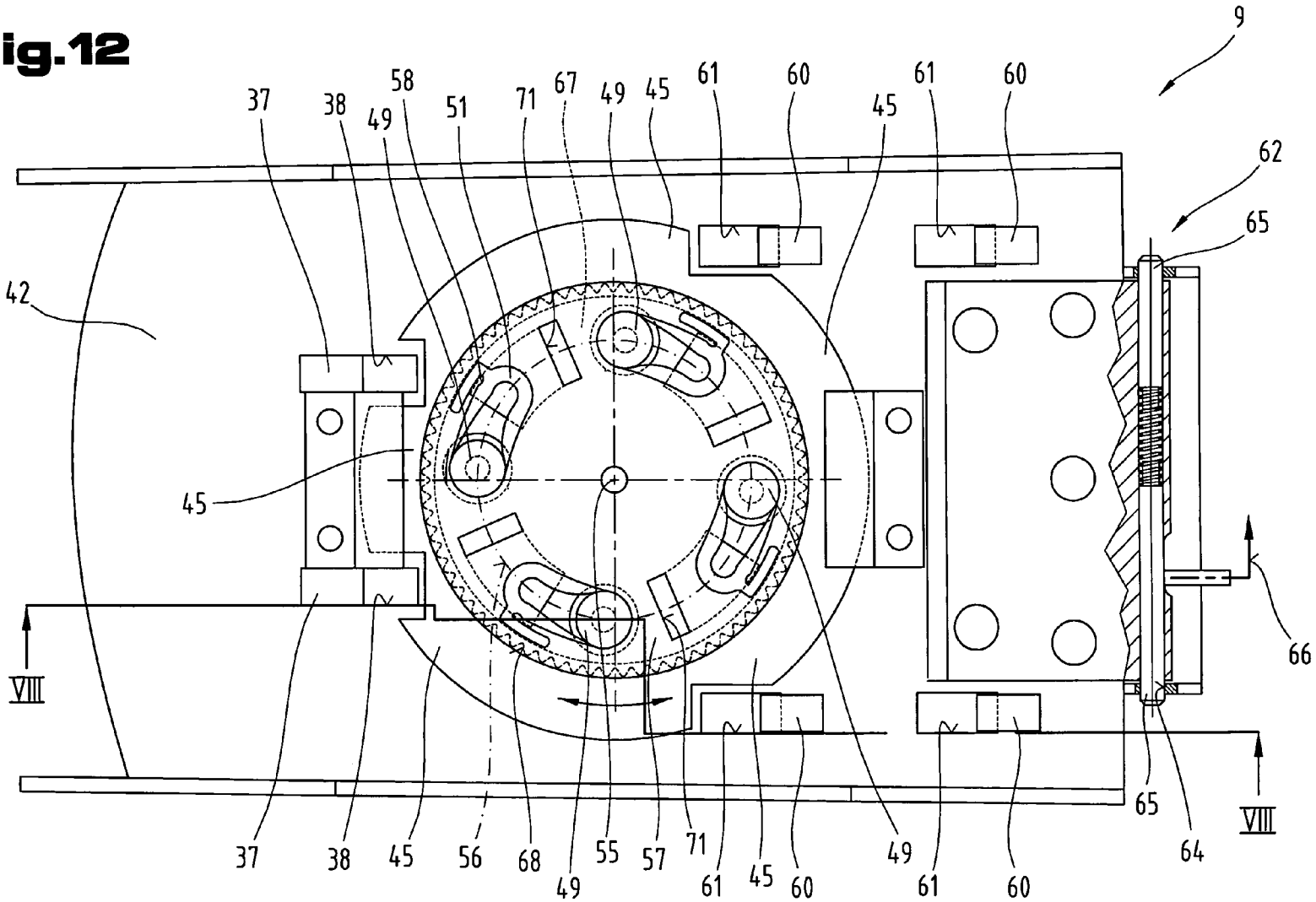
FIG. 12 is a simplified, schematic diagram showing a plan view in partial section showing the binding mechanism for the gliding device.
Figure 13:
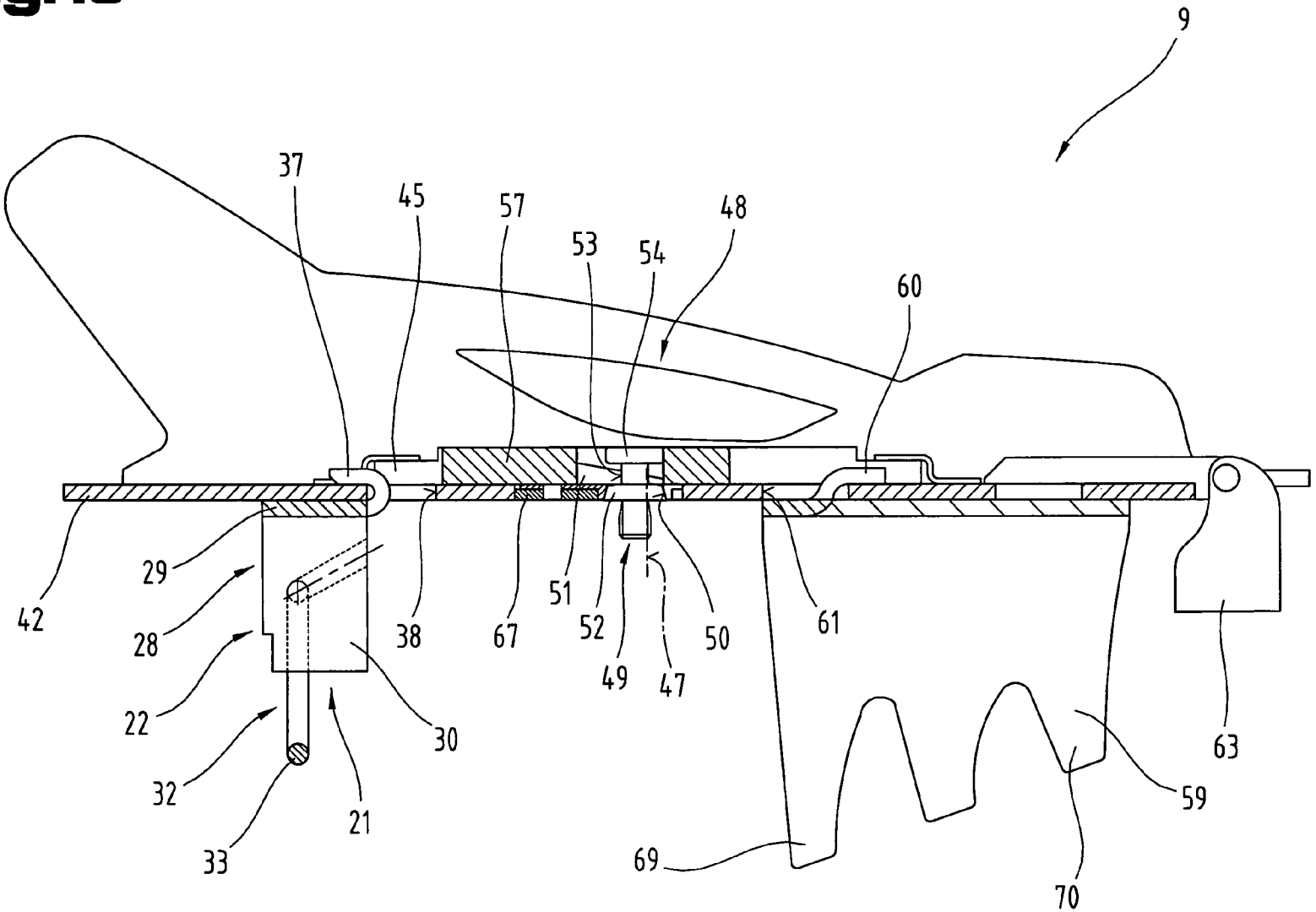
FIG. 13 shows the binding mechanism illustrated in FIG. 12 viewed in section along line XIII-XIII indicated in FIG. 12 and without the gliding device.

FIGS. 12 and 13 illustrate the binding mechanism 9 for the gliding device 1 and the gliding part-devices 5, 6, and it should be pointed out that the binding mechanism 9 may optionally be construed as a separate invention or embodiment in its own right, independently of the gliding device 1 and the gliding part-devices 5, 6. In order to avoid unnecessary repetition, reference may be made to the detailed description of FIGS. 1 to 11 above. Again, the same reference numbers and names are used for parts that are the same as those described in connection with FIGS. 1 to 11 above. To provide better clarity, a cover element which may be fitted on the binding mechanism 9 or the base plate 42 on the side facing the shoe has been omitted from the drawing.

As explained briefly above, the first and second coupling mechanisms 7, 8 are provided as a means of mutually connecting and coupling the gliding part-devices 5, 6. In the first operating position, the binding mechanism 9 therefore serves as a first coupling element 48 of the second coupling mechanism 8 and co-operates respectively with several second coupling elements 49 disposed on the two gliding part-devices 5, 6 in the portion of the longitudinal edges 12, 13 extending in a straight line. The first coupling element 48 on the binding mechanism 9 comprises at least one coupling orifice 50 and a lock element 51. The second coupling element 49 in this instance is provided in the form of a coupling pin 52, provided with a recess 53 and a support element 54. The recess 53 may be provided in the form of an undercut, for example. The support element 54 may in turn be provided in the form of a collar, for example. The lock element 51 is designed so that it can be moved relative to the coupling orifice 50 from a release position into a locked position. In the locked position, the lock element 51 extends round the support element 54 and thus locates in the recess 53. If a plurality of second coupling elements 49 is provided, these are disposed stationary on the gliding part-devices 5, 6 on either side of the longitudinal edges 12, 13.

In order to couple the two coupling elements 48, 49 of the second coupling mechanism 8, the binding mechanism 9 with its base plate 42 incorporating the coupling orifices 50 which together constitute the first coupling element 48 is placed on the second coupling elements 49. Once the lock element or elements 51 is moved, a rigid lock is produced between the two coupling elements 48, 49 due to their initially wedge-shaped design. This clamps the two gliding part-devices 5, 6 and the binding mechanisms 9. The gliding device 1 has therefore assumed its first operating mode and can be used as a snowboard.

As may be seen more clearly from FIG. 12, the first and second coupling elements 48, 49 are disposed on a common pitch circle 56 with a center 55. In the case of a symmetrical distribution, this will result in a quadratic arrangement of the coupling elements 48, 49 relative to one another.

This makes it possible to place the binding mechanism 9 on the top face 23 and simultaneously on the second coupling elements 49 and lock it solely by means of the rotatably or pivotably mounted lock element 51 without any further relative movement between the base plate 42 and the gliding device 1. The lock element 51 may be provided or disposed on the disc-shaped component 57, in which case the lock elements 51 can be pivoted or rotated together with the component 57 about the center 55 of the common pitch circle 56 of the first and second coupling elements 48, 49.

As may also be seen from FIG. 12, another and in particular a resilient locking element 58 co-operates with the lock element 51 or is provided for it, which lies on the on the coupling element 49, in particular the collar-shaped support element 54, in the locked position. The locking element 51 or component 57 is therefore prevented from inadvertently working loose or twisting.

The disc-shaped component 57 with the lock elements 51 also incorporates the blocking element 45 briefly described above, which forms the outer periphery of the component 57 in the embodiment described as an example here. When the gliding part-devices 4, 5 are in the second operating mode, the blocking element 45 extends into a coupling path between the coupling part 37 and the coupling recess 38 and serves as a climbing aid 22—in other words when the coupling part 37 of the second coupling means 21 is inserted in the coupling recess 38 of the binding mechanism 9. The position of the blocking element 45 or component 57 illustrated in FIG. 12 represents the release position for the coupling part 37 in the coupling recess 38. When pivoted as indicated by the double arrow, the disc-shaped component 57 pivots about the center 55. Consequently, the blocking element or elements 45 are transferred into an overlapping position with the coupling recess 38, thereby preventing the inserted climbing aid 22 formed by the second coupling means 21 from becoming loose or unintentionally falling out.

As also illustrated in FIG. 13, what is known as a crampon 59 can also be attached to the base plate 42 of the binding mechanism 9. The lock mechanism of the crampon 59 is of a design similar to that described above in connection with the coupling part 37 and the coupling recess 38 for the climbing aid 22. The coupling part of the crampon 59 is denoted by reference number 60 and the coupling recess by reference number 61. The coupling parts 59 are released from and inserted as well as retained and blocked in the coupling recesses by corresponding release positions in the region of the outer circumference of the disc-shaped component 57 and an arrangement of blocking elements 45. If both the climbing aid 22 and the crampon 59 are attached to the binding mechanism 9, in particular the base plate 42, the blocking elements 45 disposed around the circumference of the disc-shaped component 57 are released and locked or blocked by the displacements or pivoting movements described above.

When the binding mechanism 9 is disposed on the gliding device 1 in the first operating position, it is not possible to fit the climbing aid 22 or the crampon 59. The position or orientation of the individual blocking elements 45 with respect to the coupling recesses 38 respectively 61 is therefore irrelevant. In this instance, only the coupling action between the two coupling elements 48, 49 and hence the connection of the binding mechanism 9 to the gliding device 1 is important.

In order to change the relative position of the binding mechanism 9, in particular the base plate 42, with respect to the longitudinal axis 2 and the second coupling elements 49 disposed in a stationary position on the gliding part-devices 5, 6, an adjusting disc 67 incorporating the coupling orifice 50 may be inserted in the base plate 42. This adjusting disc 67 may have external toothing 68 in the region of its external circumference, which co-operates with preferably complementary internal toothing provided in the base plate 42. In the first operating mode, therefore, the user is able to set the desired relative angular position of the binding mechanism 9 with respect to the longitudinal axis 2 of the gliding device 1 to suit his individual requirements. The position of the co-operating first and second coupling elements 48, 49 remains unaffected by this.

On the side which digs into the ground underneath, the crampon 59 is provided with teeth 69, 70 disposed on the sides of the crampon 59 facing away from one another in the direction of the longitudinal extension of the gliding part-devices 5, 6. These teeth 69, 70 may be used to effect the relative displacement of the disc-shaped component 57, in which case they can be inserted in slots 71 in order to effect a turning movement. The crampon can therefore also be used as a tool. Furthermore, one of the teeth 69, 70 may also be used as a means of releasing the first coupling mechanism 7. Accordingly, the tooth 69, 70 may be used as a levering tool, by means of which the biased bracket part 32 can be pivoted upwards over the catch lug 36 of the base body 27, thereby enabling the coupled position of the coupling means 20, 21 to be released.

In terms of the overall design of the gliding device 1 together with all the associated component units described above, it is of advantage to adapt the latter with regard to the functions and operating modes, thereby resulting in a multi-functional system. For example, the second coupling means 21 of the first coupling mechanism 7 is used on the one hand for the operation of attaching the two gliding part-devices 5, 6 and on the other hand serves as a climbing aid 22 for climbing. The base plate 42 of the binding mechanism 9 is used not only as a bed plate for the binding function but also as a first coupling means 48 for the second coupling mechanism 8 and hence for establishing the mutual connection or coupling between the gliding part-devices 5, 6. Moreover, however, it is also used as a binding unit for climbing purposes in conjunction with the retaining part 63 of the bearing arrangement 62. Finally, the crampon 59 is used not only to ensure safer movement during climbing but may also be used as a hand tool, such as an adjusting key, for rotating or moving the disc-shaped component 57 by inserting it in the slots 71.

The embodiments illustrated as examples represent possible design variants of the gliding device 1 with its individual component units and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the gliding device 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3, 4, 5, 6, 7, 8, 9, 10; 11; 12, 13 constitute independent solutions proposed by the invention in their own right. The objectives and associated solutions proposed by the invention may be found in the detailed descriptions of these drawings.

LIST OF REFERENCE NUMBERS

1 Gliding device 26 Base body
2 Longitudinal axis 27 Base body
3 End portion 28 Base body
4 End portion 29 Base part
5 Gliding part-device 30 Leg part
6 Gliding part-device 31 Connecting element
7 Coupling mechanism 32 Bracket part
8 Coupling mechanism 33 Base part
9 Binding mechanism 34 Leg part
10 Direction of use 35 Pivot pin
11 Direction of use 36 Catch lug
12 Longitudinal edge 37 Coupling part
13 Longitudinal edge 38 Coupling recess
14 Gliding surface 39 Catch orifice
15 Longitudinal edge 40 Catch orifice
16 Longitudinal edge 41 Stop element
17 Curve 42 Base plate
18 Curve 43 Height
19 Tip 44 Height
20 Coupling means 45 Blocking element
21 Coupling means 46
22 Climbing aid 47 Rotation axis
23 Top face 48 Coupling element
24 Orifice 49 Coupling element
25 Orifice 50 Coupling orifice
51 Lock element
52 Coupling pin
53 Recess
54 Support element
55 Center
56 Pitch circle
57 Component
58 Locking element
59 Crampon
60 Coupling part
61 Coupling recess
62 Bearing arrangement
63 Retaining part
64 Orifice
65 Bolt
66 Arrow
67 Adjusting disc
68 External toothing
69 Tooth
70 Tooth
71 Slot

What is claimed is:

1. A multi-functional gliding device with a first end portion and an opposite end portion spaced at a distance apart from one another in the direction of a longitudinal axis, the multi-functional gliding device being designed to be split in a longitudinal extension to form a first gliding part-device and a second gliding part-device, the multi-functional gliding device having at least one first coupling mechanism and at least one second coupling mechanism disposed separated in the direction of the longitudinal extension and for providing a mutual connection between the first and second gliding part-devices, the first and second gliding part-devices constituting a first operating mode when coupled with one another and a second operating mode in a position separated from one another, and having a binding mechanism, wherein, in the first operating mode, the first and second gliding part-devices in the coupled position form the first end portion defining a first direction of use, wherein in the second operating mode in the position separated from one another, a first opposite end portion of the opposite end portion and a second opposite end portion of the opposite end portion define a second direction of use opposite the first direction of use, wherein the at least one first coupling mechanism is disposed at or near at least one of the first end portion and the opposite end portion, wherein the at least one second coupling mechanism is disposed nearer a longitudinal halfpoint of the multi-functional gliding device than the at least one first coupling mechanism is disposed by the longitudinal halfpoint, wherein the at least one first and at least one second coupling mechanisms have respective at least one first and at least one second coupling elements, wherein in the first operating mode, the at least one first coupling element is retained respectively on the first and second gliding part-devices disposed directly adjacent to one another and co-operates with the at least one second coupling element in order to couple the first and second gliding part-devices, and wherein in the second operating mode, a base plate of the binding mechanism is pivotably retained relative to the first and second gliding part-devices in a region of a shoe tip, the base plate having a base plate coupling element, the at least one second coupling element of the at least one first coupling mechanism having a third coupling element coupled with the base plate coupling element and forming at least one climbing aid for the binding mechanism.

2. The multi-functional gliding device according to claim 1, wherein the first end portion in the first operating mode is bounded by a single first substantially-convex curve extending between outwardly lying longitudinal edges of the multi-functional gliding device.

3. The multi-functional gliding device according to claim 2, wherein in the second direction of use, the first opposite end portion is bounded by an arcuate, convex second curve and the second opposite end portion is bounded by an arcuate, convex third curve.

4. The multi-functional gliding device according to claim 1, wherein in the first operating mode, the first longitudinal edges are mutually facing and extend in a straight line as viewed in a longitudinal extension of the multi-functional gliding device.

5. The multi-functional gliding device according to claim 1, wherein in the first operating mode, outwardly lying longitudinal edges extending on the outside of the first and second gliding part-devices respectively form an arcuately curved contour on the first gliding part-device and the second gliding part-device.

6. The multi-functional gliding device according to claim 5, wherein the outwardly lying longitudinal edges respectively form mutually facing inner edges of the first and second gliding part-devices in the second operating mode.

7. The multi-functional gliding device according to claim 1, wherein the at least one second coupling element of the at least one first coupling mechanism also comprises a U-shaped base body, with a first base part and first leg parts, and a connecting element retained on the first base part, the connecting element and first leg parts pointing substantially in a same direction of extension.

8. The multi-functional gliding device according to claim 7, wherein the at least one second coupling element of the at least one first coupling mechanism also has a U-shaped bracket part comprising a second base part and second leg parts and the second leg parts are pivotably connected to the first leg parts of the U-shaped base body.

9. The multi-functional gliding device according to claim 8, wherein when the at least one first coupling element of the at least one first coupling mechanism and the at least one second coupling element of the at least one first coupling mechanism are in the coupled position, the connecting element of the at least one second coupling element of the at least one first coupling mechanism is inserted in aligned orifices of the at least one first coupling element of the at least one first coupling mechanism and the U-shaped base body extends around certain parts of the at least one first coupling element of the at least one first coupling mechanism, and the first base part is supported on one of the at least one first coupling element of the at least one first coupling mechanism and the second base part of the U-shaped bracket part extends over another of the at least one first coupling element of the at least one first coupling mechanism and pushes the two at least one first coupling elements of the at least one first coupling mechanism against one another in the vertical direction by reference to the first longitudinal edges disposed between the first and second gliding part-devices.

10. The multi-functional gliding device according to claim 8, wherein at least one stop element is provided on at least one of the first leg parts of the U-shaped base body, and wherein the at least one stop element cooperates with the U-shaped bracket part and fixes the U-shaped bracket part in position relative to the U-shaped base body.

11. The multi-functional gliding device according to claim 1, wherein the base plate coupling element of the base plate of the binding mechanism is a coupling recess, and wherein in the second operating mode the third coupling element is at least one coupling part inserted in the coupling recess in the binding mechanism and serving as the at least one climbing aid.

12. The multi-functional gliding device according to claim 11, wherein the at least one second coupling element of the at least one first coupling mechanism also comprises a U-shaped base body, with a first base part and first leg parts, and a connecting element retained on the first base part, the connecting element and first leg parts pointing substantially in the same direction of extension, wherein the at least one second coupling element of the at least one first coupling mechanism also has a U-shaped bracket part comprising a second base part and second leg parts and the second leg parts are pivotably connected to the first leg parts of the base body, and wherein in the second operating mode, the first leg parts define a first height and the second base part of the U-shaped bracket part forms a bigger second height in co-operation with the first leg parts.

13. The multi-functional gliding device according to claim 1, wherein, in the first operating position, the binding mechanism forms the at least one first coupling element of the at least one second coupling mechanism and co-operates with a plurality of second coupling elements respectively disposed on the first and second gliding part-devices in a portion of the first longitudinal edges of the multi-functional gliding device extending in a straight line, the plurality of second coupling elements forming the at least one second coupling element of the at least one second coupling mechanism.

14. The multi-functional gliding device according to claim 13, wherein the at least one first coupling element of the at least one second coupling mechanism and the plurality of second coupling elements are disposed on a common pitch circle with a center.

15. The multi-functional gliding device according to claim 13, wherein the at least one first coupling element of the at least one second coupling mechanism comprises at least one coupling orifice and a lock element and each second coupling element of the plurality of second coupling elements comprises a respective coupling pin and a respective support element, the respective coupling pin having a recess, and wherein the lock element can be moved relative to the at least one coupling orifice from a release position into a locked position and the lock element extends under the respective support element and thus is located in the recess of the respective coupling pin in the locked position.

16. The multi-functional gliding device according to claim 15, wherein the lock element is disposed on a disc-shaped component and can be pivoted or rotated about a center of a common pitch circle of the at least one first coupling element of the at least one second coupling mechanism and the plurality of second coupling elements.

17. The multi-functional gliding device according to claim 15, wherein another locking element of a resilient design co-operates with the lock element and lies against the respective support element in the locked position.

18. A multi-functional gliding device with a first end portion and an opposite end portion spaced at a distance apart from one another in the direction of a longitudinal axis, the multi-functional gliding device being designed to be split in a longitudinal extension to form a first gliding part-device and a second gliding part-device, the multi-functional gliding device having at least one first coupling mechanism and at least one second coupling mechanism disposed separated in the direction of the longitudinal extension and for providing a mutual connection between the first and second gliding part-devices, the first and second gliding part-devices constituting a first operating mode when coupled with one another and a second operating mode in a position separated from one another, and having a binding mechanism, wherein, in the first operating mode, the first and second gliding part-devices in the coupled position form the first end portion defining a first direction of use and, in the second operating mode in the position separated from one another, a first opposite end portion of the opposite end potion and a second opposite end portion of the opposite end portion define a second direction of use opposite the first direction of use, wherein the at least one first coupling mechanism is disposed at or near at least one of the first end portion and the opposite end portion, wherein the at least one second coupling mechanism is disposed nearer a longitudinal halfpoint of the multi-functional gliding device than the at least one first coupling mechanism is disposed by the longitudinal halfpoint, wherein the at least one first and at least one second coupling mechanisms have respective at least one first and at least one second coupling elements, and in the first operating mode, the at least one first coupling element is retained respectively on the first and second gliding part-devices disposed directly adjacent to one another and co-operates with the at least one second coupling element in order to couple the first and second gliding part-devices, and in the second operating mode, the at least one second coupling element of the at least one first coupling mechanism forms at least one climbing aid for the binding mechanism, and wherein the at least one first coupling element of the at least one first coupling mechanism has a block-shaped design and has respective orifices disposed in alignment with one another in a vertical direction by reference to first longitudinal edges of the multi-functional gliding device extending in a straight line between the first and second gliding part-devices in the first operating mode.

19. A multi-functional gliding device with a first end portion and an opposite end portion spaced at a distance apart from one another in a direction of a longitudinal axis, the multi-functional gliding device being designed to be split in a longitudinal extension to form first and second gliding part-devices, the multi-functional gliding device having at least one first coupling mechanism and at least one second coupling mechanism disposed separated in the direction of the longitudinal extension and for providing a mutual connection between the first and second gliding part-devices, the first and second gliding part-devices constituting a first operating mode when coupled with one another and a second operating mode in a position separated from one another, and having a binding mechanism, wherein, in the first operating mode, the first and second gliding part-devices in the coupled position form a first end portion defining a first direction of use and, in the second operating mode in the position separated from one another, a first opposite end portion of the opposite end portion and a second opposite end portion of the opposite end portion define a second direction of use opposite the first direction of use, wherein, in the first operating mode, the binding mechanism forms a first coupling element of the at least one second coupling mechanism and co-operates with a plurality of second coupling elements respectively disposed on the first and second gliding part-devices in a portion of first longitudinal edges of the multi-functional gliding device extending in a straight line, wherein the first coupling element comprises at least one coupling orifice and a lock element and each second coupling element of the plurality of second coupling elements comprises a respective coupling pin and a respective support element, the respective coupling pin having a recess, and wherein the lock element can be moved relative to the at least one coupling orifice from a release position into a locked position and the lock element extends under the respective support element and thus is located in the recess of the respective coupling pin in the locked position, wherein the lock element is disposed on a disc-shaped component and can be pivoted or rotated about a center of a common pitch circle of the first coupling element and the plurality of second coupling elements, and wherein the disc-shaped component has at least one blocking element extending into a coupling path between a coupling part of a second coupling element of the at least one second coupling mechanism and a coupling recess in the binding mechanism when the first and second gliding part-devices are in the second operating mode and the coupling part is inserted in the coupling recess.

* * * * *